US011441814B2

(12) United States Patent
Shiotsu et al.

(10) Patent No.: US 11,441,814 B2
(45) Date of Patent: Sep. 13, 2022

(54) WATER HEATING DEVICE

(71) Applicant: NORITZ CORPORATION, Hyogo (JP)

(72) Inventors: Naoya Shiotsu, Akashi (JP); Masaki Kondo, Kobe (JP)

(73) Assignee: NORITZ CORPORATION, Hyogo (JP)

( * ) Notice: Subject to any disclaimer, the term of this patent is extended or adjusted under 35 U.S.C. 154(b) by 0 days.

(21) Appl. No.: 17/275,184

(22) PCT Filed: Aug. 22, 2019

(86) PCT No.: PCT/JP2019/032780
§ 371 (c)(1),
(2) Date: Mar. 10, 2021

(87) PCT Pub. No.: WO2020/066386
PCT Pub. Date: Apr. 2, 2020

(65) Prior Publication Data

US 2021/0325084 A1 Oct. 21, 2021

(30) Foreign Application Priority Data

Sep. 26, 2018 (JP) ..... JP2018-180344

(51) Int. Cl.
*F24H 8/00* (2022.01)
*F24H 1/14* (2022.01)
(Continued)

(52) U.S. Cl.
CPC ..... *F24H 1/145* (2013.01); *F24H 9/0026* (2013.01); *F24H 9/146* (2013.01)

(58) Field of Classification Search
CPC .. F24H 8/00; F24H 1/208; F28F 9/005; F28F 1/325; F28F 3/02; F28F 9/013; F28D 1/0477; F28D 1/0408
See application file for complete search history.

(56) References Cited

U.S. PATENT DOCUMENTS 5,163,508 A * 11/1992 Hamos ..... F28F 1/36 165/181
10,139,127 B2 * 11/2018 Miura ..... F24H 1/145
(Continued)

FOREIGN PATENT DOCUMENTS

JP S54153433 10/1979
JP H07146003 6/1995
(Continued)

OTHER PUBLICATIONS

Office Action of China Counterpart Application, with English translation thereof, dated Sep. 14, 2021, pp. 1-14.
(Continued)

*Primary Examiner* — Gregory A Wilson
(74) *Attorney, Agent, or Firm* — JCIPRNET

(57) ABSTRACT

A water heating device includes: a heat exchanger having a case to which heating air is supplied, and heat transfer pipes accommodated inside the case; and a straightening vane arranged on the downstream side in a heating air flow direction of the heat transfer pipes, and having a plurality of vent holes. The heat transfer pipe includes a plurality of pipe body portions that extend along a direction intersecting the heating air flow direction and approach the straightening vane. The plurality of vent holes are arranged so as to overlap the plurality of pipe body portions in the heating air flow direction.

5 Claims, 6 Drawing Sheets

(51) Int. Cl.
*F24H 9/00* (2022.01)
*F24H 9/14* (2006.01)

(56) References Cited

U.S. PATENT DOCUMENTS

| | | | | |
|---|---|---|---|---|
| 11,131,481 | B2 * | 9/2021 | Park | F23J 13/04 |
| 2011/0155079 | A1 * | 6/2011 | Matsunaga | F28D 7/0075 122/15.1 |
| 2014/0326197 | A1 * | 11/2014 | Deivasigamani | F28D 7/0075 165/145 |

FOREIGN PATENT DOCUMENTS

| | | |
|---|---|---|
| JP | H09189491 | 7/1997 |
| JP | 2000227255 | 8/2000 |
| JP | 2003509650 | 3/2003 |
| JP | 2017207271 | 11/2017 |
| JP | 2018109485 | 7/2018 |

OTHER PUBLICATIONS

"International Search Report (Form PCT/ISA/210)" of PCT/JP2019/032780, dated Nov. 12, 2019, with English translation thereof, pp. 1-4.

* cited by examiner

WATER HEATING DEVICE

CROSS-REFERENCE TO RELATED APPLICATION

This application is a 371 application of the International PCT application serial no. PCT/JP2019/032780, filed on Aug. 22, 2019, which claims the priority benefits of Japan Patent Application No. 2018-180344, filed on Sep. 26, 2018. The entirety of each of the above-mentioned patent applications is hereby incorporated by reference herein and made a part of this specification.

BACKGROUND

Technical Field

The present invention relates to a water heating device which generates hot water by recovering heat from heating air such as combustion gas or the like by using a heat transfer pipe.

Related Art

As specific examples of water heating devices, there are water heating devices described in Patent literatures 1 and 2. The water heating devices described in the literatures include a heat exchanger in which a heat transfer pipe used for recovering heat from combustion gas generated by a burner to heat water is disposed inside a case, and a straightening vane disposed on the downstream side in a combustion gas flow direction of the heat exchanger. The straightening vane has a plate-like main body portion which blocks the downstream side in the combustion gas flow direction of the heat exchanger, and a plurality of vent holes for allowing the combustion gas to pass through are arranged on the main body portion. The straightening vane is useful for moderating an airflow resistance of a combustion gas flow path, for example, for preventing oscillating combustion during strong combustion of the burner. In addition, when the combustion gas passes through the heat exchanger, the straightening vane is also useful for eliminating great flow deviation of the combustion gas to one side in a width direction of the heat exchanger, and for uniformizing an action degree of the combustion gas with respect to each portion of the heat transfer pipe.

However, in the related art, as described below, there is still room for improvement.

In the water heating device, an amount of the heat recovered by the heat transfer pipe from the combustion gas is required to be increased, and thermal efficiency is required to be improved as much as possible. Meanwhile, the straightening vane is used for objects such as generating the moderate airflow resistance, suppressing the deviation in the combustion gas flow, and the like, but in the related art, a relative positional relationship between the plurality of vent holes arranged on the straightening vane and the heat transfer pipe is hardly considered. Therefore, the straightening vane and the heat transfer pipe have a relationship as shown in FIG. 9.

In a configuration shown in FIG. 9, a straightening vane 4*e* approaches a heat transfer pipe 6*e* and is positioned below the heat transfer pipe 6*e*. Pipe body portions 60*e* on a lowest end and a plurality of vent holes 40*e* of the straightening vane 4*e* positionally deviate from each other in a left-right width direction. In this configuration, if the combustion gas advances downwards from an upper side of the pipe body portion 60*e* with respect to the pipe body portion 60*e* on the lowest end, the combustion gas flows toward two vent holes 40*e* in a state of branching to the left and right when passing through a disposing location of the pipe body portion 60*e*. As a result, the combustion gas does not effectively act on a lower surface portion Sa (the portion on the downstream side in the combustion gas flow direction) of the pipe body portion 60*e*. Thus, from the viewpoint of the increase in the heat recovery amount and the improvement in thermal efficiency, there is still room for improvement.

LITERATURE OF RELATED ART

Patent Literature

Patent literature 1: Japanese Patent Laid-Open No. 2017-207271

Patent literature 2: Japanese Patent Laid-Open No. 2018-109485

SUMMARY

Problems to be Solved

The present invention aims to provide a water heating device which can eliminate or suppress the above defects.

Means to Solve Problems

In order to solve the above problems, in the present invention, the following technical measures are taken.

A water heating device provided by the present invention includes: a heat exchanger having a case to which heating air is supplied, and at least one heat transfer pipe accommodated inside the case; and a straightening vane arranged on a downstream side of the heat transfer pipe in a heating air flow direction, and having a plurality of vent holes which allow the heating air that has passed through an arrangement region of the heat transfer pipes to advance toward an equipment or a member at a rear stage of the heat exchanger. The heat transfer pipe includes a plurality of pipe body portions that extend along a direction intersecting the heating air flow direction and approach the straightening vane, and the plurality of vent holes are disposed so as to overlap the plurality of pipe body portions in the heating air flow direction.

Preferably, in the water heating device according to the present invention, the heat transfer pipe includes, a plurality of meandering heat transfer pipes obtained in a way that a plurality of straight pipe body portions are continuously joined via a plurality of connection pipe body portions, wherein the plurality of straight pipe body portions are lined up in an up-down height direction and extend in a horizontal direction, and the plurality of meandering heat transfer pipes are lined up in a horizontal direction. The straightening vane approaches the plurality of meandering heat transfer pipes and is arranged in a horizontal posture below the plurality of meandering heat transfer pipes. The plurality of straight pipe body portions which are positioned on a lowest end of each of the plurality of meandering heat transfer pipes correspond to the plurality of pipe body portions that extend along the direction intersecting the heating air flow direction and approach the straightening vane.

Preferably, distances between the straightening vane and the plurality of pipe body portions are set to ½ or less of an outer diameter of the plurality of pipe body portions.

Preferably, diameters or widths of the plurality of vent holes are smaller than an outer diameter of each of the plurality of pipe body portions.

Preferably, the plurality of vent holes have long-hole shapes or slit shapes extending in an axial direction of each of the plurality of pipe body portions.

Preferably, the equipment or the member at the rear stage of the heat exchanger is an exhaust case which is connected to an exhaust duct for exhausting the heating air after heat recovery to the outside, and guides the heating air that has passed through the heat exchanger to the exhaust duct.

Other features and advantages of the present invention will be more apparent from the following description of embodiments of the present invention with reference to accompanying drawings.

DESCRIPTION OF THE EMBODIMENTS

Preferable embodiments of the present invention are described below specifically with reference to the drawings.

Figure 1:
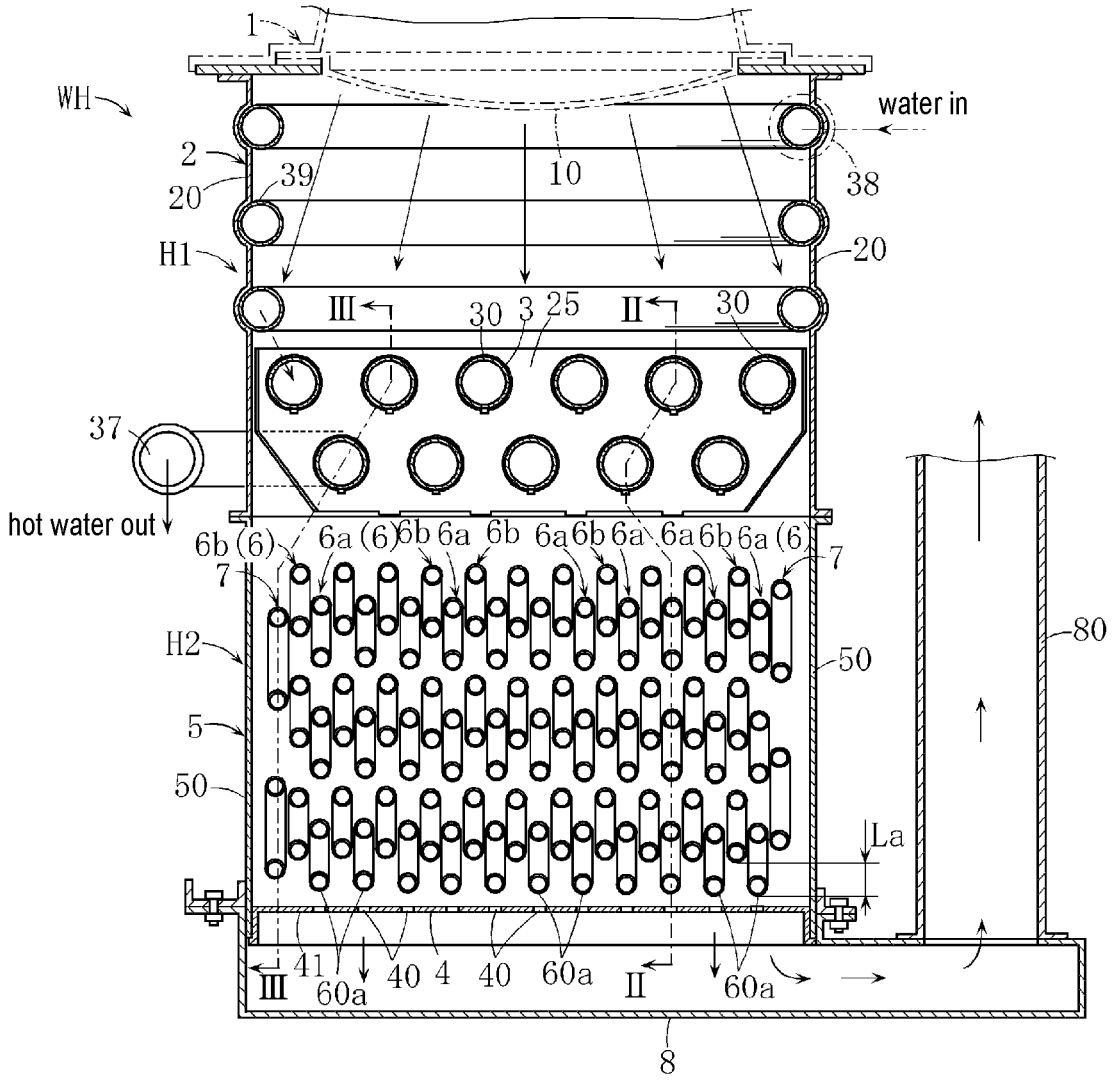
FIG. 1 is a front cross-sectional view of a relevant part showing an example of a water heating device according to the present invention.

A water heating device WH shown in FIG. 1 includes a burner 1 in which a part is shown by a virtual line, a primary heat exchanger H1, a secondary heat exchanger H2, a straightening vane 4, an exhaust case 8, and an exhaust duct 80.

The burner 1 is of a so-called reverse combustion type gas burner known conventionally. In the burner 1, a fuel gas is mixed with combustion air discharged from a fan (not shown), and the fuel-air mixture is injected downwards into a case 2 of the primary heat exchanger H1 via a fuel-air mixture injection member 10 having air permeability. The fuel-air mixture is ignited, and the combustion gas used as a heating gas is supplied into the case 2.

The primary heat exchanger H1 is used for sensible heat recovery and includes, in addition to the case 2, a heat transfer pipe 3 accommodated inside the case 2, a plurality of fins 25 for heat absorption, and a plurality of body pipes 39. The body pipes 39 are arranged along inner surfaces of a plurality of sidewall portions 20, and play a role in heat absorption for water heating and in cooling the plurality of sidewall portions 20 of the case 2. The heat transfer pipe 3 has a configuration in which a plurality of straight pipe body portions 30, which are laterally installed inside the case 2 and lined up in an up-down direction and a horizontal direction, are continuously connected via a plurality of bend pipes 36 (see FIG. 2 and FIG. 3), and the heat transfer pipe 3 is a so-called fin tube to which the plurality of fins 25 are bonded and. After passing through the body pipes 39, water supplied to a water inlet 38 of the body pipes 39 flows into the heat transfer pipe 3 and reaches a hot water outlet 37, and the water heating is performed in this process.

Figure 2:
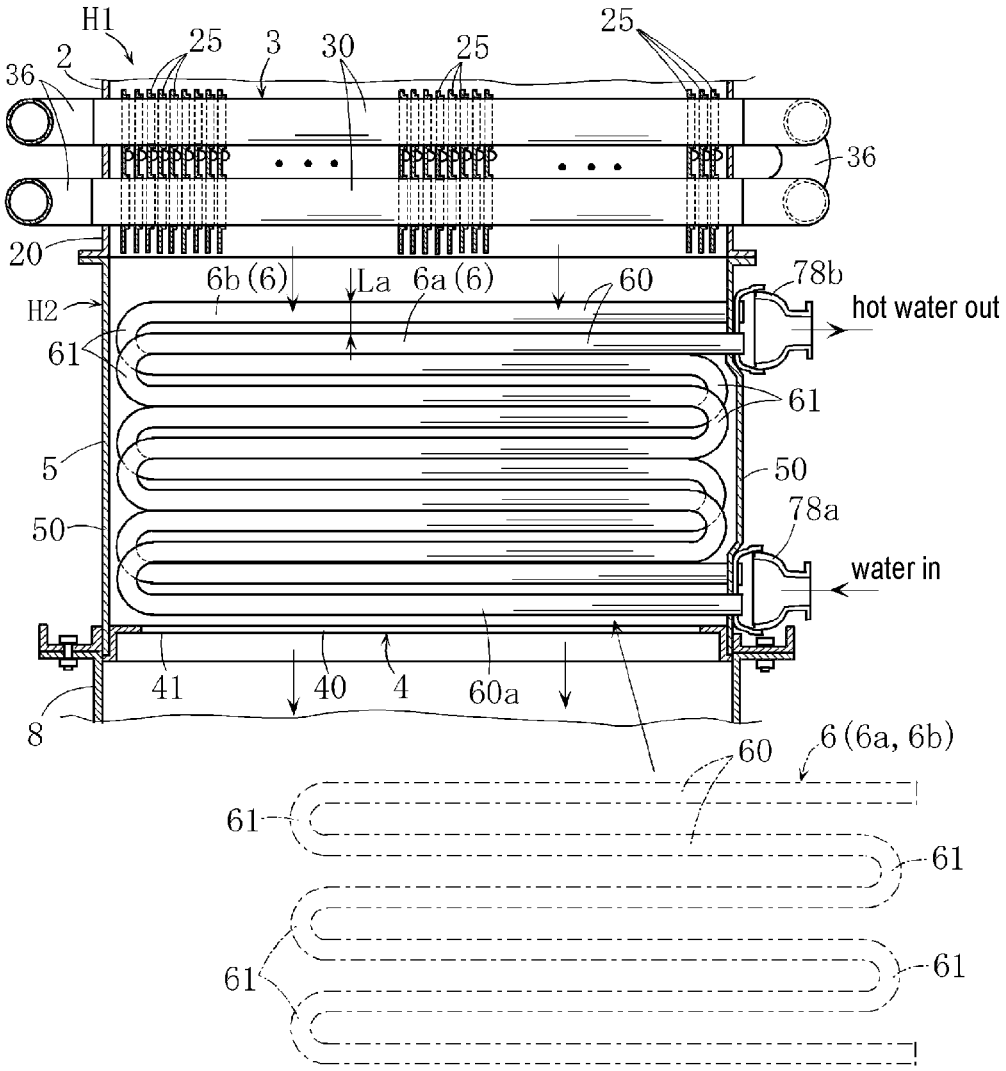
FIG. 2 is a cross-sectional view taken along a II-II line of FIG. 1.

The secondary heat exchanger H2 is used for latent heat recovery, is connected to a lower side of the primary heat exchanger H1, and has a configuration in which first heat transfer pipes 6 (6*a* and 6*b*) and second heat transfer pipes 7 are accommodated inside a case 5. The first heat transfer pipes 6 and the second heat transfer pipes 7 are all meandering heat transfer pipes. As shown in FIG. 2, the first heat transfer pipe 6 has a meandering shape in which a plurality of straight pipe body portions 60 extending in the horizontal direction are continuously joined via a plurality of connection pipe body portions 61 having semi-circular shapes in a side view, and is in a standing posture in which each of the straight pipe body portions 60 is lined up in an up-down height direction.

Herein, a height step is set between the adjacent first heat transfer pipes 6, and these first heat transfer pipes 6 are in a zigzag arrangement in a front view of FIG. 1. An overall height of each of the first heat transfer pipes 6*a* is lowered by an appropriate dimension La compared with that of each of the first heat transfer pipes 6*b*. This height difference is effective in improving a contact degree of the combustion gas to the first heat transfer pipes 6 and improving thermal efficiency.

Figure 3:
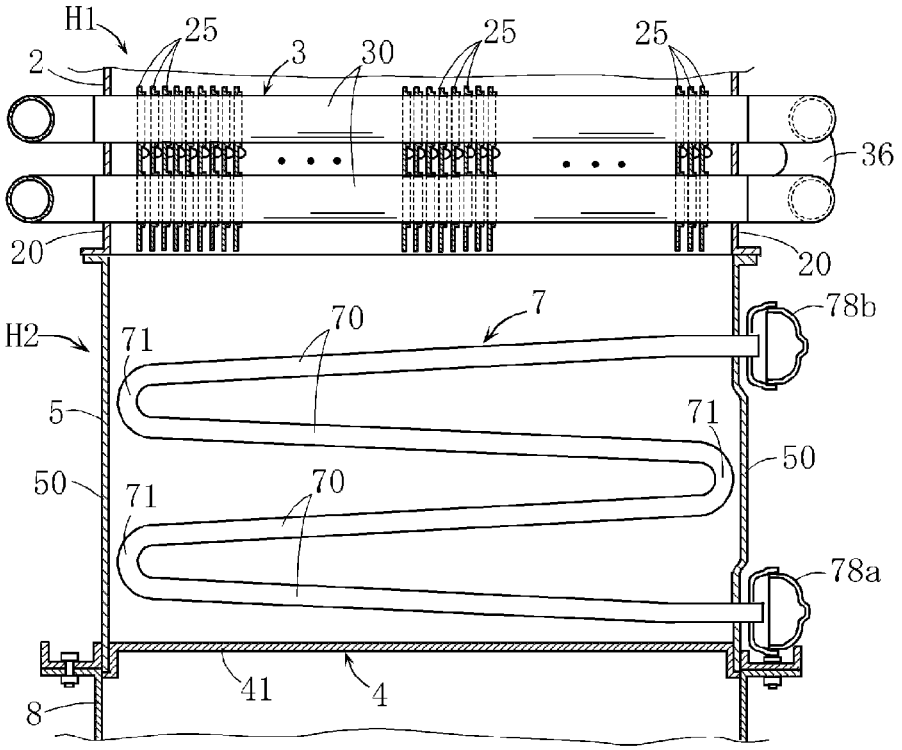
FIG. 3 is a cross-sectional view taken along a III-III line of FIG. 1.

As shown in FIG. 3, the second heat transfer pipe 7 has a meandering shape in which straight pipe body portions 70 inclined up and down are continuously joined via a plurality of connection pipe body portions 71 having semi-circular shapes in a side view, and is in a standing posture in which each of the straight pipe body portions 70 is lined up in the up-down height direction. Both end portions of the first heat transfer pipe 6 and the second heat transfer pipe 7 are respectively connected to a head 78*a* for water in and a head 78*b* for hot water out which are arranged on the outside of the case 5. Unheated water is supplied to the head 78*a* for water in. Thereafter, the water passes through the first heat transfer pipes 6 and the second heat transfer pipes 7 and reaches the head 78*b* for hot water out, and then the water is supplied to the water inlet 38 of the primary heat exchanger H1 (herein, the flow of the water is not limited hereto).

Because each of the straight pipe body portions 70 is inclined up and down, the second heat transfer pipes 7 has an excellent draining performance, and even when the inside of the first heat transfer pipes 6 is frozen in winter, the hot water can also be supplied by making the water flow in the second heat transfer pipes 7. As shown in FIG. 1, the second heat transfer pipes 7 are arranged in a width direction of the secondary heat exchanger H2 at a total of two locations, for example, are positioned on both left and right outer sides of the plurality of first heat transfer pipes 6.

The exhaust case 8 is a case-like member which is connected to a lower portion of the secondary heat exchanger H2 and in which the combustion gas (exhaust gas) which has passed through the secondary heat exchanger H2 downwards and of which the heat recovery has been completed flows into the inside, and the exhaust case 8 corresponds to an example of "an equipment or a member at a rear stage of the heat exchanger". Thereafter, the exhaust gas which has entered the exhaust case 8 passes through the exhaust duct 80 and is guided to a predetermined exhaust outlet (not shown) to be discharged to the outside.

The straightening vane 4 has a body portion 41 in which a plurality of vent holes 40 are formed, and the body portion 41 has a plate-like shape that is substantially rectangular in a plan view. The straightening vane 4 is disposed inside the case 5 of the secondary heat exchanger H2 and below the plurality of first heat transfer pipes 6 and the plurality of second heat transfer pipes 7 (on the downstream side in the combustion gas flow direction). The main body portion 41 is arranged so as to block the inside of the case 5, and the combustion gas of which the heat recovery is completed by the secondary heat exchanger H2 passes through the plurality of vent holes 40 and advances to the inside of the exhaust case 8.

Described more specifically, the straightening vane 4 has a configuration described below.

Figure 4A:
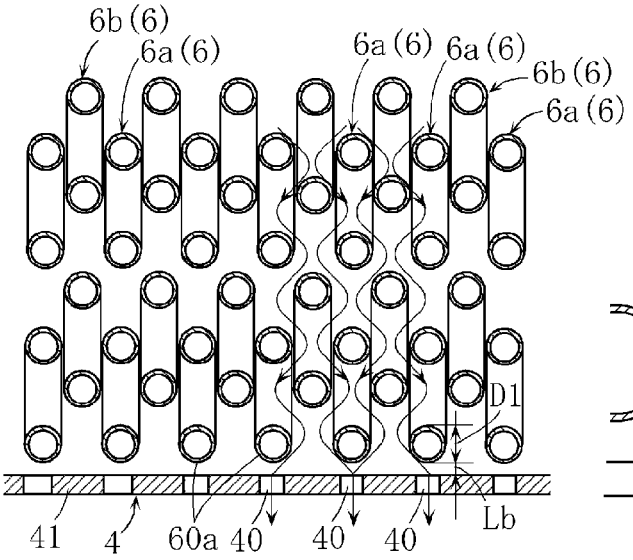
FIG. 4A is an enlarged cross-sectional view of a relevant part of FIG. 1.
Figure 4B:
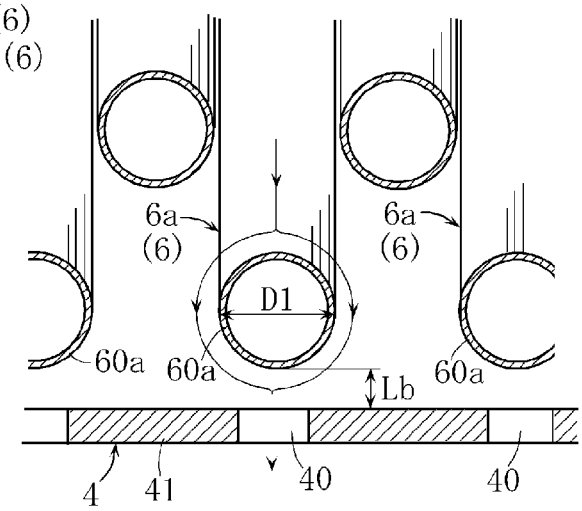
FIG. 4B is a cross-sectional view obtained by further enlarging one part of FIG. 4A.

As clearly shown in FIG. 4A and FIG. 4B, the plurality of vent holes 40 of the straightening vane 4 are positioned directly below straight pipe body portions 60*a* (60) positioned on lowest ends of the first heat transfer pipes 6*a* (6), and are disposed so as to overlap the straight pipe body portions 60*a* in the combustion gas flow direction. The straight pipe body portions 60*a* correspond to an example of "a plurality of pipe body portions that extend along a direction intersecting the heating air flow direction and approach the straightening vane". The vent holes 40 are disposed not corresponding to the first heat transfer pipes 6*b* (6) and the second heat transfer pipes 7. The straightening vane 4 is disposed so as to approach the straight pipe body portions 60*a*, and distances Lb between the straightening vane 4 and the straight pipe body portions 60*a* are preferably ½ or less of outer diameters D1 of the straight pipe body portions 60*a*.

Figure 5:
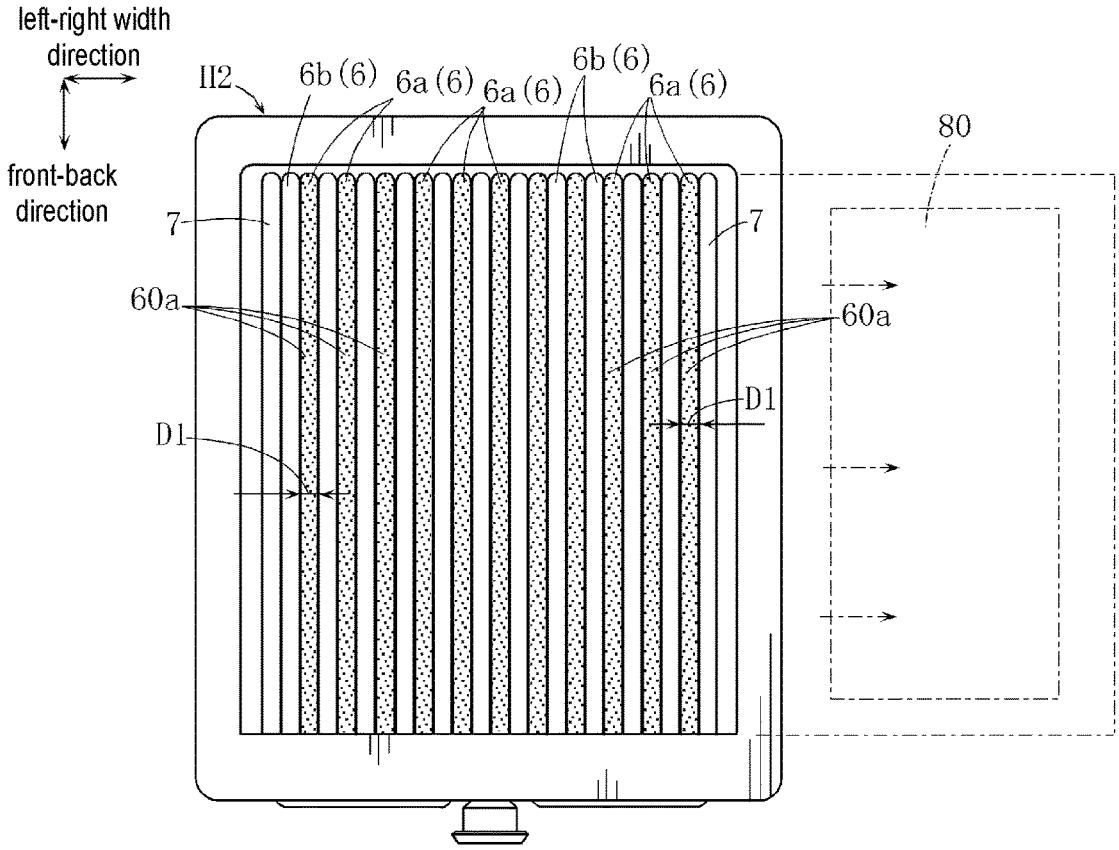
FIG. 5 is a bottom view of a secondary heat exchanger of the water heating device shown in FIG. 1.

FIG. 5 is a bottom view of the secondary heat exchanger H2, and the straight pipe body portions 60*a* on the lowest ends of the plurality of first heat transfer pipes 6*a* are marked with halftone dot patterns. Each of the straight pipe body portions 60*a* extends in a front-back direction of the secondary heat exchanger H2. With respect to this, as shown in FIG. 6, the plurality of vent holes 40 of the straightening vane 4 are formed in long-hole shapes or slit shapes extending in a direction the same as that of each of the straight pipe body portions 60*a*.

Figure 6:
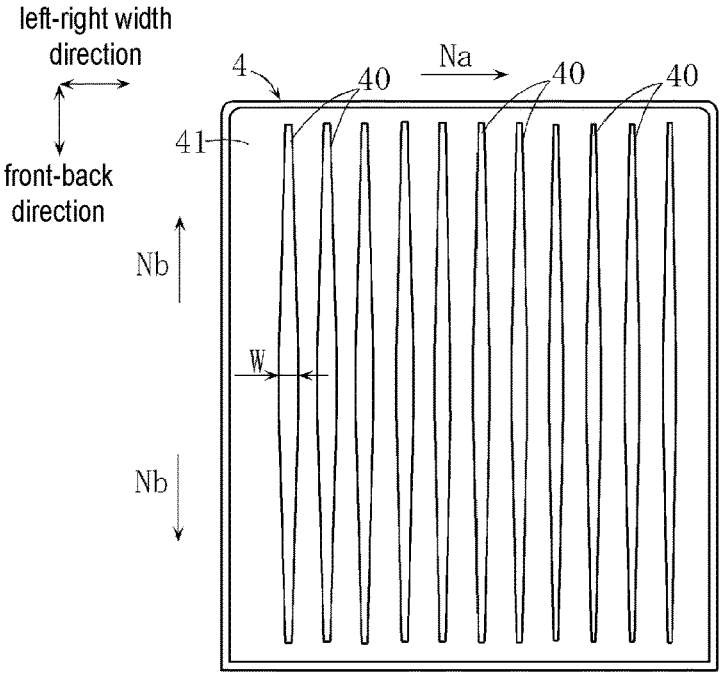
FIG. 6 is a bottom view of a straightening vane of the water heating device shown in FIG. 1.

With regard to widths W of the plurality of vent holes 40 in a short-side direction (a left-right width direction of the secondary heat exchanger H2), a vent hole 40 positioned on a left end of FIG. 6 is the widest, and the widths W gradually become narrower when advancing to a right side shown by an arrow Na. In the embodiment, the exhaust duct 80 is positioned on a right side of the secondary heat exchanger H2. Therefore, if the widths of various places of the plurality of vent holes 40 are unified to be the same, there is a possibility that an amount of combustion gas passing through vent holes 40 on a left-side region of the straightening vane 4 may be less than an amount of combustion gas passing through vent holes 40 on a right-side region, and a deviation may be generated in the distribution of the amount of combustion gas flowing inside the secondary heat exchanger H2. The above configuration is useful for eliminating this possibility and for improving thermal efficiency of the secondary heat exchanger H2.

Each of the vent holes 40 has a shape in which the vicinity of a central portion in the front-back direction has a widest width and a width of each of the vent holes 40 becomes narrower when advancing from the vicinity of the central portion to both front and back end sides shown by arrows Nb. Thereby, an amount of combustion gas flowing in a region close to the centre of a front-back width direction of the secondary heat exchanger H2 is increased and an amount of combustion gas flowing along a sidewall portion 50 of the case 5 is reduced, which is useful for improving the thermal efficiency of the secondary heat exchanger H2.

Herein, the width W of each of the plurality of vent holes 40 is smaller than the outer diameter D1 of the straight pipe body portion 60*a*.

Next, actions of the above water heating device WH are described.

Firstly, the combustion gas generated by the burner 1 passes through the primary heat exchanger H1 and the secondary heat exchanger H2, passes through the plurality of vent holes 40 of the straightening vane 4, and flows into the exhaust case 8. Here, when the combustion gas flows inside the secondary heat exchanger H2, the flow of the combustion gas is roughly shown by arrows in FIG. 4A. In addition, as shown in FIG. 4B, when the combustion gas reaches the position of the straight pipe body portion 60*a* on the lowest stage, the combustion gas branches to the left and right and flows in the vicinity of an upper surface portion and a side surface portion of an outer peripheral surface of the straight pipe body portion 60*a*, but due to the existence of the vent hole 40 in the vicinity directly below the straight pipe body portion 60*a*, the combustion gas wraps around a region below the straight pipe body portion 60*a*. Thus, the combustion gas also effectively acts on a lower surface portion of the outer peripheral surface of the straight pipe body portion 60*a*, and efficiently acts on the whole outer peripheral surface of the straight pipe body portion 60*a*. As a result, the amount of the heat recovered by the first heat transfer pipes 6 can be increased, and the thermal efficiency can be improved.

Particularly, in the embodiment, the plurality of vent holes 40 have distances approaching the straight pipe body portions 60*a* which are ½ or less of the outer diameters D1 of the straight pipe body portions 60*a*, and the widths W in the short-side direction of the plurality of vent holes 40 are smaller than the outer diameters D1. Therefore, the action of the combustion gas wrapping around the region below the straight pipe body portions 60*a* is more reliably achieved. In addition, as described with reference to FIG. 6, because the plurality of vent holes 40 have the long-hole shapes or the slit shapes extending in the longitudinal direction of the straight pipe body portions 60*a*, the action of the combustion gas wrapping around the region below the straight pipe body portions 60*a* is achieved over a substantially entire length region of the straight pipe body portions 60*a* in the longitudinal direction. Thus, the thermal efficiency can be further improved.

Figure 7:
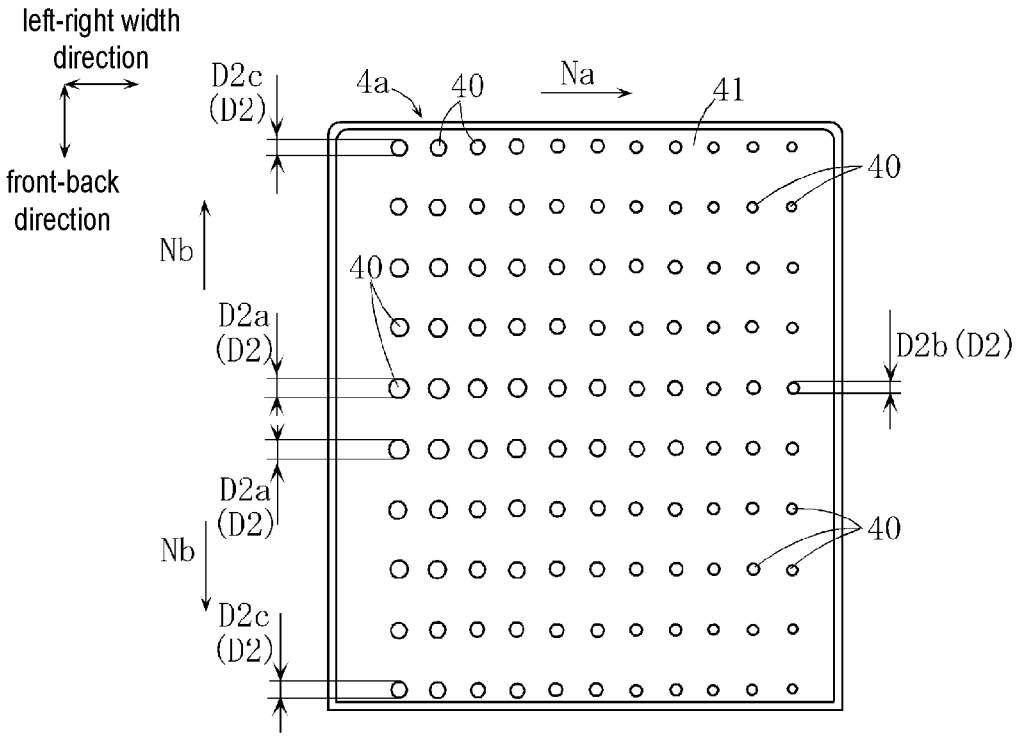
FIG. 7 is a bottom view showing another example of the straightening vane.
Figure 8A:
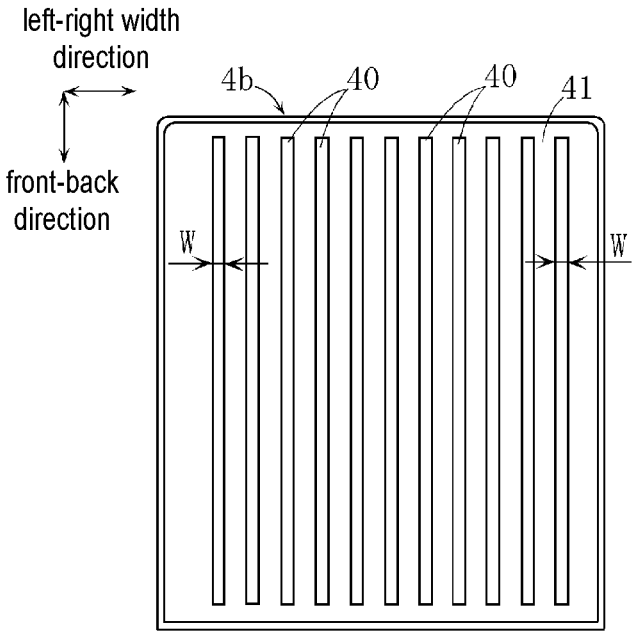
FIG. 8A and FIG. 8B are bottom views showing other examples of the straightening vane.
Figure 8B:
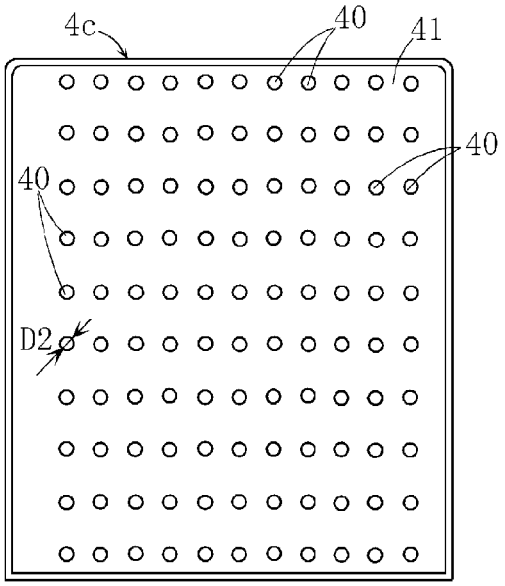
Figure 9:
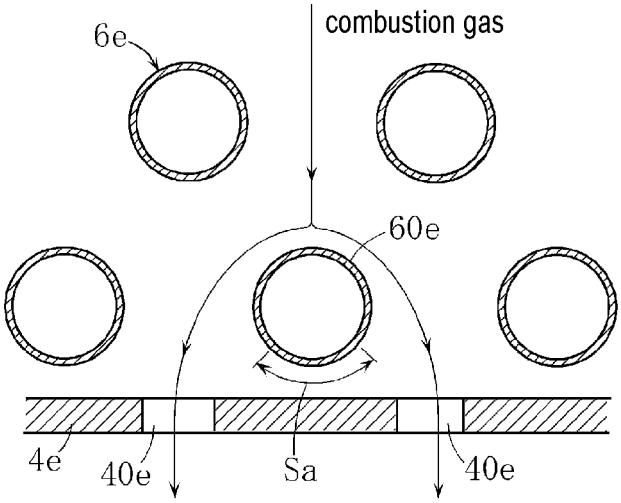
FIG. 9 (Related Art)
FIG. 9 is a cross-sectional view of a relevant part showing an example of the related art.

FIG. 7 to FIG. 8B show other embodiments of the present invention. In these drawings, elements the same as or similar to those of the above embodiment are marked with the signs the same as those of the above embodiment, and repeated descriptions are omitted.

On the straightening vane 4*a* shown in FIG. 7, each of the plurality of vent holes 40 is a circular hole. Each of the vent holes 40 is positioned directly below the straight pipe body portion 60*a* on the lowest end of the first heat transfer pipe 6*a*, which is not shown.

With regard to diameters D2 of the plurality of vent holes 40, a diameter D2 (D2*a*) of the vent hole 40 positioned in the vicinity of the central portion in the front-back direction on a left end is the greatest, the diameters D2 of the plurality of vent holes 40 become smaller when advancing to the right side shown by the arrow Na, and a diameter D2 (D2*b*) of the vent hole 40 positioned on a right end satisfies D2*a* >D2*b*. In the front-back direction of the secondary heat exchanger H2 (an up-down direction in the same drawing), the vent hole 40 in the vicinity of the central portion has a greatest diameter D2, and the diameters D2 become smaller when advancing from the vicinity of the central portion to both front and back end portion sides shown by the arrows Nb. Diameters D2*c* of the vent holes 40 positioned in the vicinity of both front and back end portions have a relationship of D2*a*>D2*c*.

In the embodiment, different from the above-described embodiment, each of the vent holes 40 is a circular hole. However, because each of the vent holes 40 is positioned directly below the straight pipe body portion 60*a* on the lowest end of the first heat transfer pipe 6*a*, the same as the above-described embodiment, the action that the present invention intends of the combustion gas wrapping around the region below the straight pipe body portions 60*a* is achieved. Because the diameters D2 of the plurality of vent holes 40 are different, an action is also achieved which is the same as the action achieved by the configuration in which the widths W of the plurality of vent holes 40 are different in the above embodiment.

On a straightening vane 4*b* shown in FIG. 8A, the plurality of vent holes 40 have long-hole shapes or slit shapes in which the widths W of various places are the same. On a straightening vane 4*c* shown in FIG. 8B, the plurality of vent holes 40 are circular holes in which the diameters D2 are unified to be substantially the same.

Even in this configuration, the plurality of vent holes 40 are positioned directly below the straight pipe body portions 60*a*, and thereby the action that the present invention intends is achieved. In the present invention, whether the widths or diameters of the plurality of vent holes are unified to be the same does not matter.

The present invention is not limited to the contents of the embodiments described above. Specific configuration of each portion of the water heating device according to the present invention can be variously and freely changed and designed in a range intended by the present invention.

The vent holes of the straightening vane are not limited to the long-hole shapes, the slit shapes, or the circular shapes, and can be vent holes having shapes other than the above shapes. In addition, the shapes of the plurality of vent holes may be not unified to be the same, and for example, both of the vent holes having long-hole shapes and the vent holes having circular shapes can also be arranged.

In the above embodiments, the plurality of vent holes 40 are arranged corresponding to all of the locations directly below each of the plurality of straight pipe body portions 60*a* on the lowest end, which is preferable for achieving the action that the present invention intends. However, the present invention is not limited hereto. A location having no vent hole 40 can also exist in a part directly below each of the plurality of straight pipe body portions 60*a* on the lowest end. In addition, a part of the vent holes 40 can also be arranged in locations different from the locations directly below the straight pipe body portions 60*a* on the lowest end.

The straightening vane 4 can also be mounted to the exhaust case 8 instead of being mounted to the secondary heat exchanger H2. In short, a configuration is possible as long as the straightening vane is disposed on the downstream side of heating air of the heat transfer pipe in the heat exchanger.

The water heating device according to the present invention is not limited to the water heating device including the primary heat exchanger and secondary heat exchanger which respectively recover sensible heat and latent heat, and can also be, for example, a water heating device only including the heat exchanger for sensible heat recovery. At this time, the straightening vane is disposed on the downstream side of the heat transfer pipe in the heat exchanger for sensible heat recovery.

The equipment or the member at the rear stage of the heat exchanger is not limited to the exhaust case.

The heat transfer pipe of the heat exchanger described in the present invention is not limited to the heat transfer pipe using the meandering pipe body, and can be a heat transfer pipe using various configurations except this.

The water heating device is not limited to the reverse combustion type and can also be, for example, a forward combustion type. In the forward combustion type, the combustion gas advances upwards, and thus the straightening vane is disposed above the heat transfer pipe of the heat exchanger.

The heating air is not limited to the combustion gas and can also be, for example, high-temperature exhaust gas generated in a cogeneration system.

What is claimed is:

1. A water heating device, comprising:

a heat exchanger having a case to which heating air is supplied, and at least one heat transfer pipe accommodated inside the case; and a straightening vane arranged on a downstream side of the heat transfer pipe in a heating air flow direction, and having a plurality of vent holes which allow the heating air that has passed through an arrangement region of the heat transfer pipe to advance toward an equipment or a member at a rear stage of the heat exchanger, wherein the heat transfer pipe comprises a plurality of pipe body portions that extend along a direction intersecting the heating air flow direction and approach the straightening vane, and the plurality of vent holes are disposed so as to overlap the plurality of pipe body portions in the heating air flow direction, wherein the heat transfer pipe comprises a plurality of meandering heat transfer pipes obtained in a way that a plurality of straight pipe body portions are continuously joined via a plurality of connection pipe body portions, wherein the plurality of straight pipe body portions are lined up in an up-down height direction and extend in a horizontal direction, and the plurality of meandering heat transfer pipes are lined up in a horizontal direction;

the straightening vane approaches the plurality of meandering heat transfer pipes and is arranged in a horizontal posture below the plurality of meandering heat transfer pipes; and the plurality of straight pipe body portions which are positioned on a lowest end of each of the plurality of meandering heat transfer pipes correspond to the plurality of pipe body portions that extend along the direction intersecting the heating air flow direction and approach the straightening vane, unheated water supplied to the water heating device is supplied to the plurality of straight pipe body portions which are positioned on the lowest end of each of the plurality of meandering heat transfer pipes in the heat exchanger.

2. The water heating device according to claim 1, wherein distances between the straightening vane and the plurality of pipe body portions are set to ½ or less of outer diameters of the plurality of pipe body portions.

3. The water heating device according to claim 1, wherein diameters or widths of the plurality of vent holes are smaller than an outer diameter of each of the plurality of pipe body portions.

4. The water heating device according to claim 1, wherein the plurality of vent holes have long-hole shapes or slit shapes extending in an axial direction of each of the plurality of pipe body portions.

5. The water heating device according to claim 1, wherein the equipment or the member at the rear stage of the heat exchanger is an exhaust case which is connected to an exhaust duct for exhausting the heating air after heat recovery to the outside and guides the heating air that has passed through the heat exchanger to the exhaust duct.

* * * * *